United States Patent [19]

Berg et al.

[11] Patent Number: 4,729,141

[45] Date of Patent: Mar. 8, 1988

[54] DISC BRUSH SUSPENSION FOR A FLOOR MAINTENANCE MACHINE

[75] Inventors: David W. Berg; Steven V. Feeny, both of Plymouth, Minn.

[73] Assignee: Tennant Company, Minneapolis, Minn.

[21] Appl. No.: 2,288

[22] Filed: Jan. 7, 1987

[51] Int. Cl.[4] ..... A47L 11/162

[52] U.S. Cl. ..... 15/49 R; 15/87; 15/340; 15/359

[58] Field of Search ..... 15/49 R, 49 C, 50 R, 15/50 C, 87, 98, 340, 385, 359; 51/177

[56] References Cited

U.S. PATENT DOCUMENTS 2,236,814 4/1941 Evans ..... 15/87 X

FOREIGN PATENT DOCUMENTS 0083840 7/1983 European Pat. Off. ..... 15/340

*Primary Examiner*—Edward L. Roberts

*Attorney, Agent, or Firm*—Kinzer, Plyer, Dorn, McEachran & Jambor

[57] ABSTRACT

This is concerned with a disc brush suspension or arrangement for a scrubber or sweeper or the like. The arrangement uses a flexible bellows which may be of rubber or a suitable rubber substitute which functions as the total or primary suspension for the disc brush and its drive motor.

5 Claims, 6 Drawing Figures

Fig. 5.
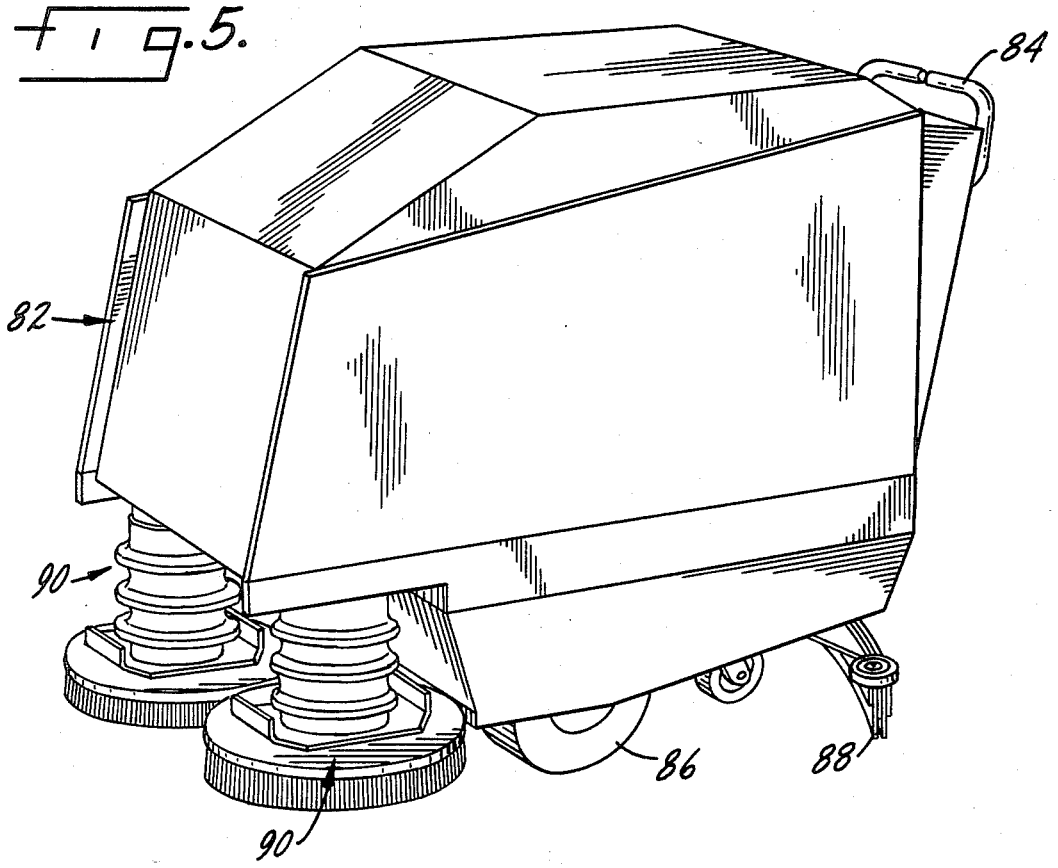
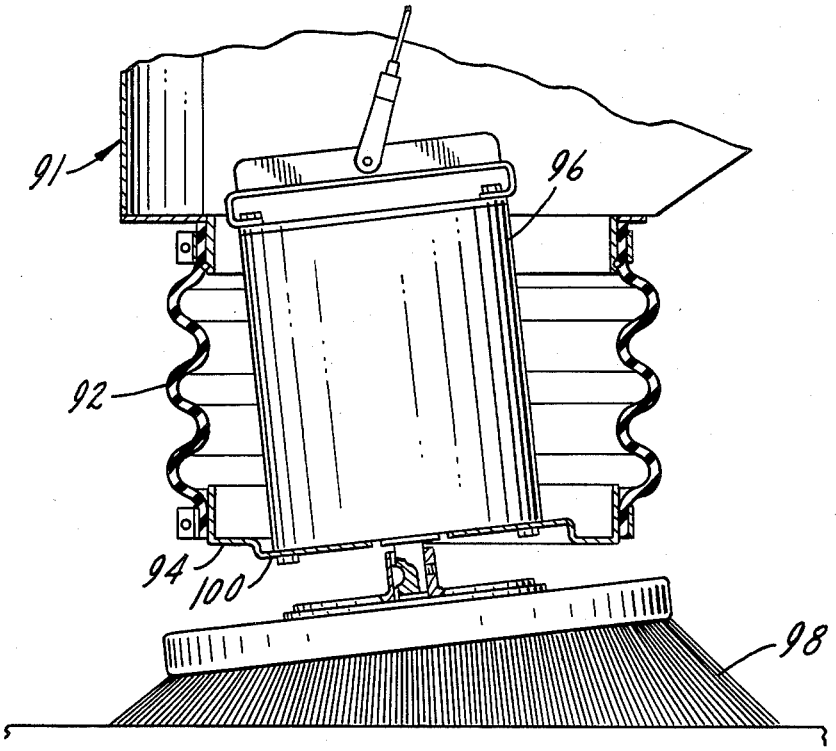
Fig. 6.

DISC BRUSH SUSPENSION FOR A FLOOR MAINTENANCE MACHINE

SUMMARY OF THE INVENTION

This is concerned with a machine in the nature of a scrubber or sweeper with a disc brush suspension that greatly simplifies the construction thereof and improves but in no event lessens performance.

A primary object of the invention is a disc brush suspension with a rubber or rubberlike bellows with the bellows being the primary or sole support for the brush drive motor to which is attached the brush.

Another object is a disc brush mounting or suspension of the above type which uses a mechanical actuator to raise and lower the brush and its motor.

Another object is a disc brush suspension of the above type which uses a vacuum arrangement for raising and lowering the brush and its motor.

Another object is a disc brush arrangement of the above type that eliminates parts.

Another object is a disc brush suspension for a scrubber or sweeper or the like which is low cost, light weight, durable and simple.

Another object is a disc brush arrangement that will deflect upon impact and absorb considerable impact without damage.

Another object is a disc brush suspension which is constructed and arranged for improved durability.

Another object is a disc brush mounting that prevents damage to the brush and its suspension.

Other objects will appear from time to time in the ensuing specification and drawings.

BRIEF DESCRIPTION OF THE DRAWINGS

FIG. 5 is a perspective view from the left front of another scrubber in which the two main scrubbing brushes are suspended by the suspension of the present invention.

FIG. 6 is a section similar to FIG. 2 but of a modified form suitable for use with a sweeper.

DETAILED DESCRIPTION OF THE PREFERRED EMBODIMENT

Figure 1:
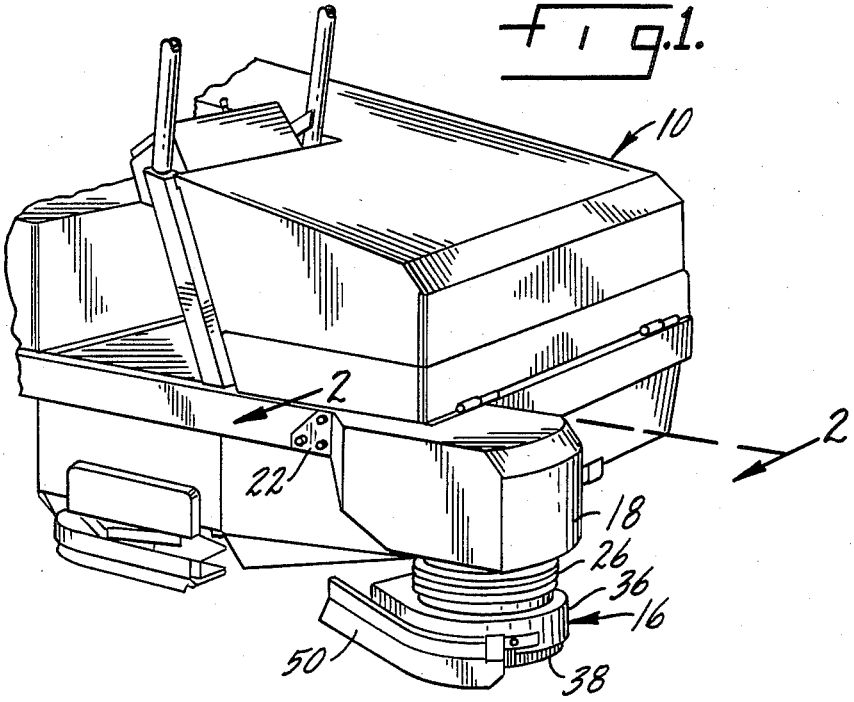
FIG. 1 is a perspective view from the right front side of a scrubber.
Figure 2:
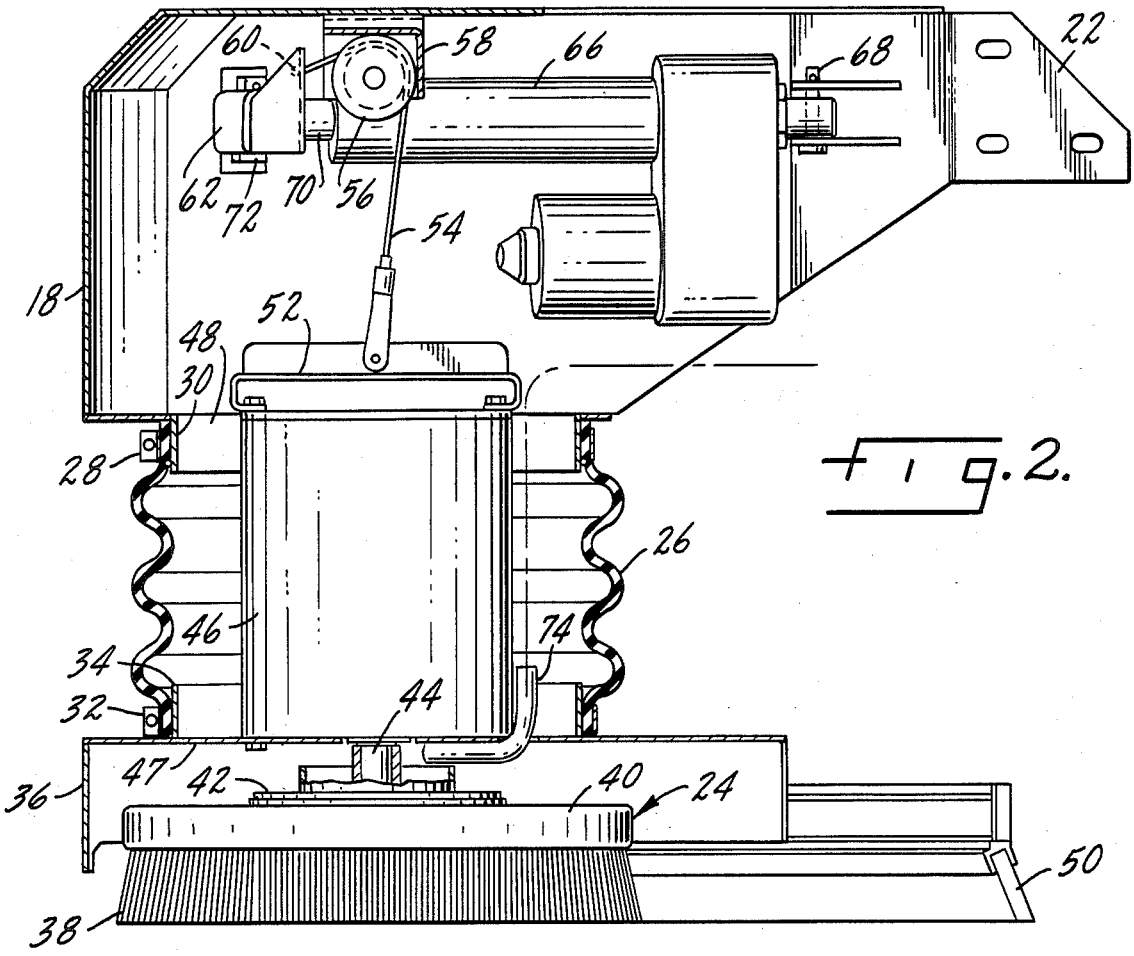
FIG. 2 is a section generally along line 2—2 of FIG. 1, on a different scale.

In FIG. 1 a conventional riding type scrubber is shown which may be assumed to have a frame or housing 10 with suitable wheels, a driver compartment, etc., all of which may be conventional. A side brush assembly is indicated generally at 16 and, as shown in detail in FIGS. 2 and 3 includes an upper assembly or housing or shroud 18 suitably connected as at 20 and 22 to the frame of the machine. The housing encloses an actuator to be explained later.

A rotatably mounted brush assembly 24 is supported or suspended by a bellows 26 which is suitably clamped as at 28 to a depending flange or ring 30 on the bottom of the housing 18. The lower end of the bellows is clamped as at 32 to an upstanding flange or ring 34 on a plate 47 which supports the brush drive motor. A shroud 36 depends from the plate 47 and generally surrounds a part of the disc brush 24. The brush includes bristles 38 on a backing 40 which is connected through a quick change mounting 42 to a drive shaft 44 of an electric motor or the like 46 the upper end of which extends through an opening 48 in the bottom of the upper housing 18. The shield or shroud 36 partially surrounding the brush may carry a suitable squeegee 50 which may be conventional. Motor 46 is mounted on and connected to the top 47 of the shroud 36.

Figure 3:
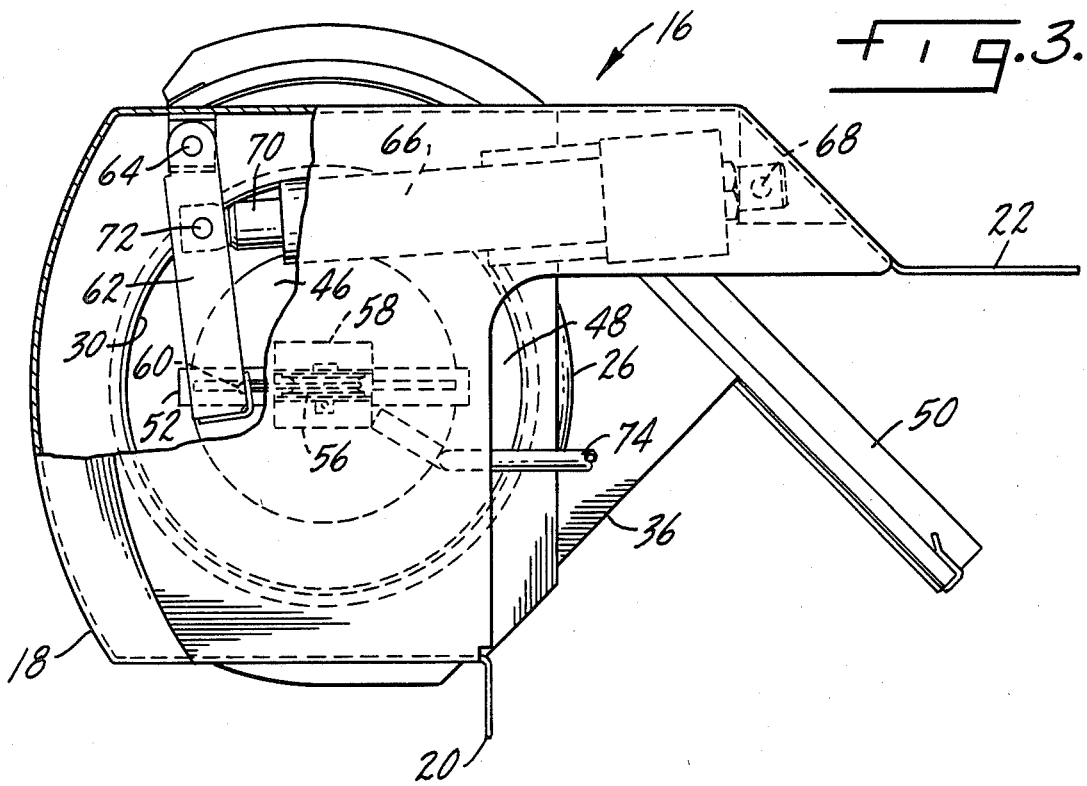
FIG. 3 is a top view of FIG. 2, partly broken away and with parts omitted.

The upper end of the motor 46 has a mounting bracket 52 to which is connected a cable 54 which passes around a pulley 56 on a bracket 58 connected in the top of the upper housing, with the cable dead-ended as at 60 on a lever 62 pivoted as at 64 in the side of the housing, as shown in FIG. 3. An electric actuator 66 may be suitably pivoted in the rear of the housing as at 68 with its extendable rod 70 connected at a suitable place as at 72 on lever 62. It will be understood by those versed in the art that a hydraulic cylinder could be substituted for the electric actuator if desired. A suitable lead line or tube 74 may extend through the housing so that cleaning fluid may be supplied through the inside of the brush to the floor to be scrubbed.

The operation and function are as follows.

The flexible bellows which has been referred to as being of rubber or a suitable rubber substitute may be any material which has the characteristics of rubber as to flexibility and distortability. It serves as the sole or primary support between the housing and the brush motor when the unit is operating. Thus in addition to sealing out dirt and dust, the bellows also flexibly supports the brush drive motor so that the brush may conform to and accept any irregularities such as hollows or bumps in the surface being worked upon. The actuator that raises and lowers the brush and motor may be of any suitable form. The bellows should be flexible enough to not exceed the motor's capabilities but still stiff enough to allow the brush to remain stable when scrubbing at high travel speed and under high torque conditions.

It should be understood that while scrubbing, the lift cable 54 will be slack and the entire weight of the brush drive motor and mounting parts for it will rest upon the disc brush. The actuator 66 operates to pick up the brush during transport.

Figure 4:
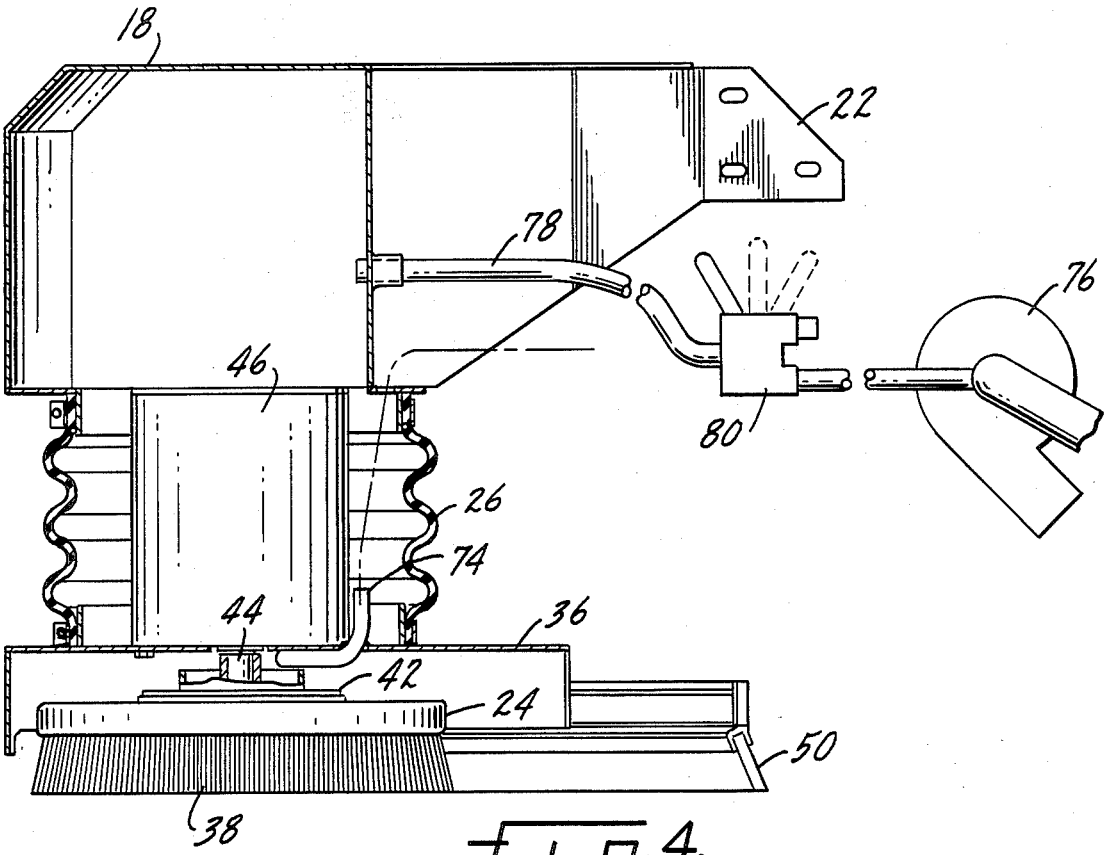
FIG. 4 is similar to FIG. 2 but of a modified form.

In FIG. 4 a variant form has been shown in which a housing, bellows, brush, etc. have been shown as before. The actuator 66 and its associated mechanism have been eliminated and the housing, bellows and connection to the brush shroud have been hermetically sealed so that the assembly is airtight. As is conventional, scrubbers of this type have a vacuum fan, shown schematically at 76 in FIG. 4, which may be connected to the sealed housing through a suitable pipe or connection 78 with a control valve 80.

In this form the normal or conventional source of vacuum on such a scrubber may be used to raise the brush and its motor by properly sealing the housing, bellows, etc., so that the vacuum will be effective to raise the brush when desired. The weight of the brush and motor will lower the brush after the bellows is vented. The forces involved are well within the ability of conventional vacuum fans on scrubbers to raise both the brush and its motor. This has the advantage that any form of mechanical, electrical or hydraulic raising and lowering mechanism is eliminated and the housing becomes a simple fabricated plenum with the connections and valving being quite simple.

In both forms the normal gimbal connection between the motor shaft and the brush is eliminated because the bellows will perform this function. In certain installations more down pressure on the brush might be desired, in which case the positive pressure side of fan 76 could be communicated to the housing and bellows.

In FIG. 5 a variant form has been shown in which a disc brush scrubber has been indicated generally at 82 and it may be assumed to have the usual frame with appropriate controls 84 for a walk behind operator with wheels 86 and a squeegee 88 of any suitable type. The scrubber shown conforms generally to the one in prior U.S. Pat. No. 4,348,783 issued Sept. 14, 1982 and sold by Tennant Company of Minneapolis, Minn. as their Model 432. Such a unit might be altered so that two scrub brushes with suspensions like those shown and described previously would be on the front in place of the two front brushes shown in U.S. Pat. No. 4,348,783. This is to say that the invention is not limited to a side brush suspension but could as well be used for one or more of the main scrubbing brushes.

In FIG. 6 a variant form has been shown in which the upper support structure 91 which includes the housing, the actuator, etc., may be the same. As before, a bellows 92 has its lower end clamped to a plate 94. The motor drive 96 for a brush 98 is disposed within the bellows and connected to the actuating mechanism as before. The lower plate 94 has an offset 100 with the motor mounted in the center thereof so that the center line of the motor is at an angle to the vertical with the brush being offset.

The brush shown here is intended to represent the gutter broom of a sweeper instead of a scrubber where the tilt of the brush allows it to release the dust under the brush and throw it into the path of the main brush. This is to say that the bellows type suspension for the scrubbing brush previously described is not restricted thereto but may as well be used with the side brush on a sweeper.

The arrangement shown and described has the advantage that it will prevent damage to the brush and its suspension because the rubber bellows can absorb considerable impact with no damage. When the brush and motor are lowered either by the electric actuator and cable or by venting the bellows in the vacuum form, the down force due to the weight of the bellows and motor will be adequate for scrubbing or sweeping, as the application may require. In addition, the arrangement presents a neat appearance and clean design.

While the preferred form and several variations of the invention have been shown, described and suggested, it should be understood that suitable additional modifications, changes, substitutions and alterations may be made without departing from the invention's fundamental theme.

The embodiments of the invention in which an exclusive property or privilege is claimed are defined as follows:

1. In a disc brush structure for a scrubber, sweeper or the like, a housing, a rotatably mounted brush below the housing disposed to rotate about a generally upright axis and power means for rotating it, a flexible bellows between the housing and power means and having the general characteristics of rubber as to flexibility and distortability, the bellows serving as the primary structural connection of the power means and brush to the housing, and means for raising and lowering the brush and power means between working and traveling positions.

2. The structure of claim 1 further characterized in that the housing, bellows and power means are all hermetically sealed, and further characterized by and including a vacuum connection thereto with a control so that the brush may be raised and lowered by either connecting or disconnecting a vacuum source through the vacuum connection.

3. The structure of claim 1 further characterized by and including an actuator in the housing connected to raise and lower the brush and power means.

4. The structure of claim 1 further characterized in that the motor axis is on line with the bellows axis.

5. The structure of claim 1 further characterized in that the motor axis is at an angle to the bellows axis.

* * * * *